United States Patent [19]

Aseltine

[11] Patent Number: 4,724,767

[45] Date of Patent: Feb. 16, 1988

[54] SHAPED CHARGE APPARATUS AND METHOD

[75] Inventor: Clifford L. Aseltine, Houston, Tex.

[73] Assignee: Schlumberger Technology Corporation, Houston, Tex.

[21] Appl. No.: 855,862

[22] Filed: Apr. 24, 1986

[51] Int. Cl.[4] ..... F42B 1/02

[52] U.S. Cl. ..... 102/307; 102/309

[58] Field of Search ..... 102/306–310, 102/476

[56] References Cited

U.S. PATENT DOCUMENTS

| | | | |
|---|---|---|---|
| 3,128,702 | 4/1964 | Cristopher | 102/20 |
| 3,215,074 | 11/1965 | Robinson, Jr. et al. | 102/308 X |
| 3,234,875 | 2/1966 | Tolson | 102/310 |
| 3,255,659 | 6/1966 | Venghiattis | 102/306 X |
| 3,416,449 | 12/1968 | Brothers | 102/476 |
| 3,732,816 | 5/1973 | Muller | 102/306 |
| 4,387,773 | 6/1983 | McPhee | 102/306 X |
| 4,436,033 | 3/1984 | Precoul | 102/476 X |
| 4,612,859 | 9/1986 | Furch et al. | 102/476 |

FOREIGN PATENT DOCUMENTS

| | | | |
|---|---|---|---|
| 1037819 | 9/1953 | France | 102/476 |

*Primary Examiner*—Peter A. Nelson

[57] ABSTRACT

A unique structure for the shaped charge allows the formation of a uniquely configured jet with an alternating velocity gradient along its length. In a preferred embodiment, the velocity of material within the jet is significantly greater at two points along its length than elsewhere. As a result, the material of the jet "bunches up" at these points, forming two bulges. The forwardmost bulge is expended as it breakes through the gun wall and travels through the borehole fluid. The second bulge grows as the jet traverses the annular space between the gun wall and the casing, providing a large diameter mass to impact the casing and form a large diameter hole therein.

6 Claims, 8 Drawing Figures

SHAPED CHARGE APPARATUS AND METHOD

BACKGROUND OF THE INVENTION

This invention relates to shaped charges for use in perforating operations in hydrocarbon wells, and more particularly to shaped charges designed to create large diameter entrance holes in well casings and surrounding earth formations.

DESCRIPTION OF THE PRIOR ART

In a typical oil or gas well, a borehole is lined with a steel casing cemented against the surrounding earth formation. Shaped charges capable of creating large diameter holes in the casing and earth formations are often desirable for enhanced flow of hydrocarbons or other fluids from the interior of the formation, or for more effective gravel packing operations. The typical shaped charge includes a steel case which forms a cavity against which a layer of explosive material is packed. A conical or bowl-shaped layer of powdered metal or sheet metal, such as copper, is then packed against the explosive layer to form the liner. In use, the shaped charge is positioned inside a tubular housing of a perforating gun, sometimes behind a port sealed with a replaceable plug (which is hereinafter intended to be included in the meaning of "gun wall").

A primer at the apex of the explosive layer is used to detonate the explosive which, as it expands, collapses the metal liner into a fluid jet and imparts an outward velocity thereto. The jet then travels at a high velocity to penetrate through the gun wall and then on through the fluids which normally fill the borehole to the casing and the earth formation.

The performance of typical prior art shaped charges suffers greatly from degradation of the jet. Passage through the gun wall and borehole fluid slows the jet and wears away its tip. Thus, the overall size of the jet and the diameter of that portion which impacts the casing are reduced considerably, as is its velocity. This results in a hole in the casing having only a small diameter.

What is needed, then, is a shaped charge which will make optimal utilization of its component parts by delivering to the casing an impacting mass having the greatest possible diameter and velocity.

SUMMARY OF THE INVENTION

In a preferred embodiment of the invention, a unique structure for the shaped charge allows the formation of a uniquely configured jet with performance characteristics which do not suffer from degradation as the jet passes through the gun wall and borehole fluids toward the well casing. Instead, the shape of the jet is optimized during this travel time to increase the diameter of that portion of the jet which will eventually impact the casing. This is accomplished by the provision of a charge case having a configuration which creates a velocity gradient along the length of the jet. In a preferred embodiment, the velocity of material within the jet is significantly greater at two points along its length than elsewhere. As a result, the material of the jet "bunches up" at these points, forming two bulges.

The forwardmost bulge is expended as it breaks through the gun wall and travels through the borehole fluid. The second bulge grows as the jet traverses the annular space between the gun wall and the casing, providing a large diameter mass to impact the casing and form a large diameter hole therein.

This is accomplished by the provision of a case having a forwardly-opening cavity having a rearward frustoconical portion with steeply tapered side walls diverging outwardly from the central axis of the case and a forward frustoconical portion with less steeply tapered side walls diverging outwardly from the central axis. The result is a shaped charge capable of creating an entrance hole of significant diameter, and maintaining hole diameter through about two inches of cement.

DETAILED DESCRIPTION OF A PREFERRED EMBODIMENT

Figure 1:
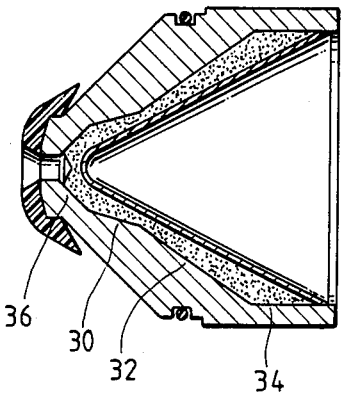
FIG. 1 is a cross-sectional view of a preferred embodiment of the invention.

In the description below, "forward" refers to the direction of travel of the jet in normal operation, and "rearward" to the reverse direction. Referring first to FIG. 1, a shaped charge 10 according to a preferred embodiment of the invention includes a case 12 of machined steel or other material of sufficient strength or density to confine the explosion of the charge. The case 12 has a outer wall 14 adapted to be held in a perforating gun by conventional means, and forms a cavity with an inner wall 16 described in detail below.

An explosive 18 such as RDX is packed against the inner wall 16 of the case 12 so as to form a conical surface against which a liner 20 of a powdered metal or sheet metal, such as copper is pressed. The liner 20 thus is cone-shaped, and with a variable or constant thickness. A small diameter bore 22 in the rearward end of the case 12 is filled with a primer 24 such as high purity RDX and covered with a primer retainer 26 such as metal foil on a paper base or, alternatively, an aluminum foil cup pressed into the case 12. A plastic cap 28 snap fit onto the rearward end of the case 12 is configured to position detonating cord (not shown) in proximity to the primer. The pressing of the explosive layer and metal liner, and the provision of primer 24 and cap 28 are accomplished by means well known in the art of shaped charge manufacture.

The inner wall 16 of the case 12 has a unique configuration to accommodate an explosive layer which causes upon detonation the formation of a fluid jet which, in contrast to that of the prior art, has an alternating velocity gradient along its length. The inner wall 16 of a preferred embodiment includes segments of alternatingly lesser and greater taper. In a preferred embodiment, the inner wall 16 includes a vertex section 36, a more steeply tapered rearward section 30, a less steeply tapered midsection 32, and a cylindrical forward section 34. In a preferred embodiment, the vertex section 36 forms an angle of 60 degrees with an axis of the conical liner 20; the rearward section 30 a 22 degree angle; and the midsection 32 a 39.5 degree angle.

As FIG. 1 shows, the resulting distribution of explosive is such that the thickness of the explosive layer 18 is neither constant, nor constantly increasing or decreasing from front to rear of the shaped charge 10. In the FIG. 1 embodiment, thickness of explosive layer 18 first increases from point A to point B, then decreases from point B to point C; and again increases from point C to point D. Thus, local maximums of explosive layer thickness are formed at points B and D.

Figure 2:
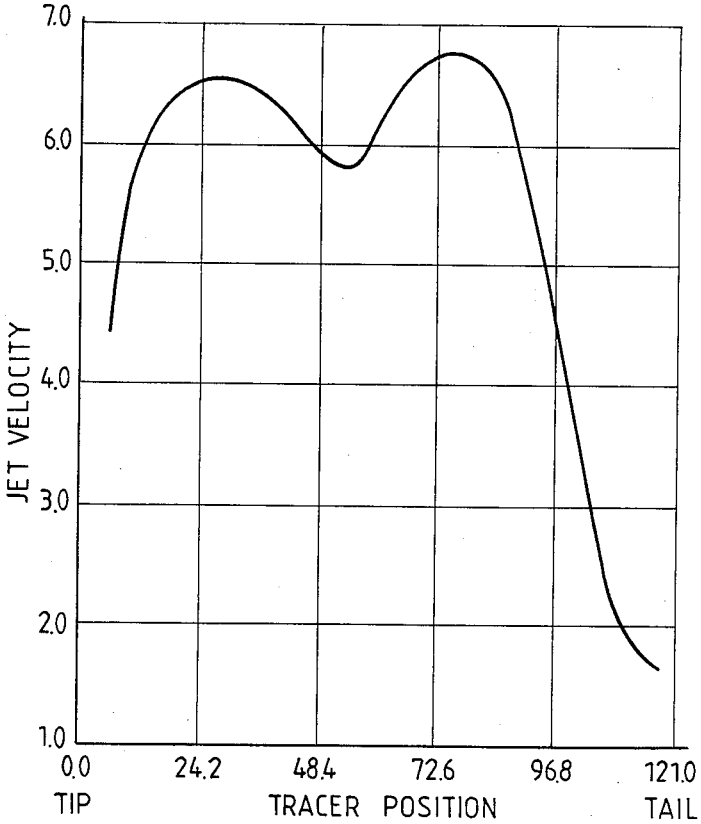
FIG. 2 is a graph of jet velocity as a function of position along the jet formed by the FIG. 1 embodiment.

In practice, this shaped charge structure has been found to result in the performance characteristics illustrated in FIGS. 2 and 3. Upon detonation the explosive material 18 expands, collapses the liner 20 into a jet 40, and propel it out of the case 12. In a typical well perforating operation, the shaped charge 10 is supported behind a gun wall 36. FIG. 3A schematically shows the relative positions of the charge 10, gun wall 36 and well casing 38 in a typical case. FIG. 3B schematically shows the jet 40 as it contacts the gun wall 36. In the time between detonation and contact of the jet tip with the gun wall, two bulges **42*a* and 42*b* have formed within the jet as a result of a non-constant velocity distribution within the jet 40. As FIG. 2 shows, the forward velocity of material in the jet 40 varies as a function of linear position within the jet 40. A velocity distribution curve 44 for a particular embodiment of the invention is shown in FIG. 2, but experimentation has shown the general properties of the curve 44 to hold true for all embodiments. Namely, velocity reaches a first local maximum 46 at a point near the forward end of the jet, and a second maximum 48** at a point farther back on the jet. As a result, material "bunches up" near these two points as time progresses, to give the two bulge configuration shown schematically in FIG. 3B.

Figure 3A:
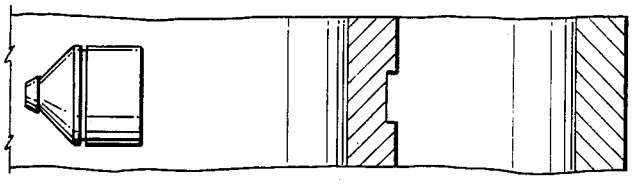
FIGS. 3A–3F are sequential schematic diagrams showing the formation and operation of the jet from the FIG. 1 embodiment.
Figure 3B:
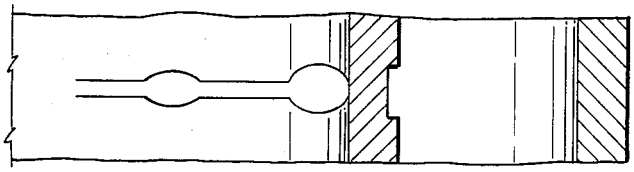
Figure 3C:
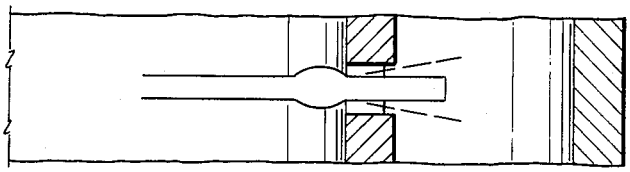
Figure 3D:
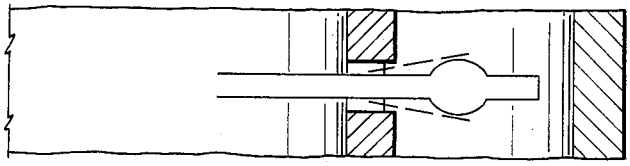
Figure 3E:
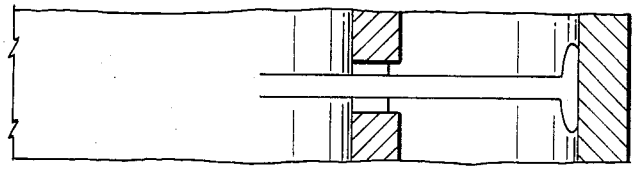
Figure 3F:
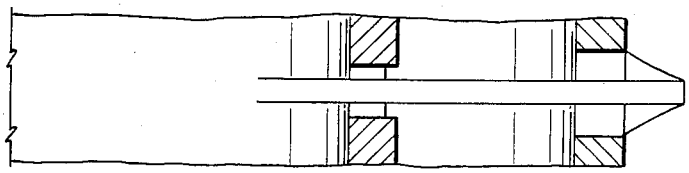

As shown in FIG. 3C, the forwardmost bulge 42 is expanded in creating a hole in the gun wall 36. In a typical case for a particular embodiment of the invention, this hole is about 0.4 to 0.5 inches in diameter, and is large enough for the remainder of the jet 40 to pass through. As the jet 40 continues to travel, that portion of the jet 40 following the forwardmost bulge **42*a* is utilized to penetrate borehole fluids and is largely expended in this process. Meanwhile, the second bulge 42*b* grows in diameter, as shown in FIG. 3D, until it contacts the casing 38. Typically, the second bulge creates a hole in the casing 38** about 0.8 to 0.85 inches in diameter. That the hole in the casing is generally larger than that in the gun wall demonstrates the optimization of jet characteristics during its travel time. In addition, shock loading of the gun is minimized even though casing hole diameter is maximized.

While the invention has been described with respect to a preferred embodiment, this has been done for illustrative purposes only. It will be understood that variations in the inner wall configuration of the case 12 and in the axial cross-sectional distribution of explosives may be made so as to obtain the particular performance characteristics desired for a particular application of the invention. Such changes and modifications to the illustrated embodiment may still fall within the scope of the invention.

What is claimed is:

1. A shaped charge comprising:

a case uniformly disposed about a central axis and having a forwardly-opening cavity therein with a rearward frustoconical portion thereof having straight walls diverging outwardly from said central axis at a first angle of divergence and a larger forward frustoconical portion thereof having straight walls diverging outwardly from said central axis at a second greater angle of divergence;

an explosive element having a conical forwardly-opening recess complementally fitted within said forwardly-opening cavity; and a conical shaped charge liner cooperatively arranged in said forwardly-opening recess of said explosive element and adapted, upon detonation thereof, to progressively develop an elongated perforating jet extending forwardly therefrom along said central axis, said first angle of divergence being less than said second angle of divergence so that as said perforating jet is developing along said perforating axis, the portion of said explosive element in said rearward frustoconical portion of said cavity will progressively collapse the adjacent portion of said liner for producing an enlarged-diameter bulge in the leading portion of said perforating jet and the portion of said explosive element in said forward frustoconical portion of said cavity will progressively collapse the adjacent portion of said liner for producing another enlarged-diameter bulge in the mid portion of said perforating jet.

2. The shaped charge of claim 1 wherein said forwardly-opening cavity further includes a cylindrical forward portion ahead of and adjoining said forward frustoconical portion of said cavity and having straight side walls substantially parallel to said central axis, with the forwardmost portions of said explosive element and said liner extending into said cylindrical forward portion of said cavity for producing the trailing portion of said perforating jet.

3. A shaped explosive charge comprising:

a case having a forwardly-opening cavity therein uniformly disposed about a central axis and cooperatively arranged with adjoining forwardly-diverging rearward and forward frustoconical portions of said cavity having straight side walls respectively defining selected first and second included angles, said first included angle being less than said second included angle;

an explosive element having a substantially-conical forwardly-opening recess therein uniformly disposed about a longitudinal axis, said explosive element being cooperatively arranged within said forwardly-opening cavity of said case with said longitudinal axis coincidentally aligned with said central axis for defining the perforating axis of said shaped charge; and a substantially-conical liner element cooperatively fitted in said forwardly-opening recess of said explosive element so that upon detonation of said explosive element said liner element will progressively collapse for producing a perforating jet extending forwardly along said perforating axis with the rearward portion of said explosive element in said rearward frustoconical portion of said cavity coacting with the apex portion of said liner element to produce a first enlarged-diameter concentration of liner particles in the leading portion of said perforating jet and the forward portion of said explosive element in said forward frustoconical portion of said cavity coacting with the base portion of said liner element to produce a second enlarged-diameter concentration of liner particles in the intermediate portion of said perforating jet.

4. The shaped charge of claim 3 wherein said forwardly-opening cavity further includes a cylindrical forward portion ahead of and adjoining said forward frustoconical portion of said cavity and having straight side walls substantially parallel to said central axis, with the forwardmost portions of said explosive element and said liner element respectively extending into said cylindrical forward portion of said cavity and coacting with one another upon detonation of said explosive element to produce the trailing portion of said perforating jet.

5. Shaped charge apparatus comprising:

a metal shaped charge container having a forwardly-opening cavity with adjoining rearward and forward frustoconical portions formed uniformly about a longitudinal axis of said container and respectively having forwardly-diverging walls;

a body of explosive material disposed in said cavity having a forwardly-opening conical recess formed uniformly about said longitudinal axis;

a primer explosive cooperatively arranged in detonating proximity of the rearward portion of said explosive body for developing a high-order detonation therein; and a conical metal liner complementally fitted into said conical recess of said explosive body and operable on response to a highorder detonation of said explosive body for producing an extended perforating jet of particles of said liner advancing along said longitudinal axis, said walls of said rearward frustoconical cavity portion defining a first included angle for coacting with the apex portion of said liner to form an enlarged-diameter concentration of said liner particles in the forward portion of said perforating jet and said walls of said forward frustoconical cavity portion defining a second included angle greater than said first included angle for coacting with the base portion of said liner to form an enlarged-diameter concentration of said liner particles in the intermediate portion of said perforating jet.

6. The shaped charge apparatus of claim 5 wherein said forwardly-opening cavity further includes a cylindrical forward portion ahead of and adjoining said forward frustoconical portion of said cavity and having straight side walls substantially parallel to said longitudinal axis, with the forwardmost portions of said explosive body and said liner respectively extending into said cylindrical forward portion of said cavity for coacting with one another upon detonation of said explosive body to produce the trailing portion of said perforating jet.

* * * * *